US012326068B2

(12) United States Patent
Shelton

(10) Patent No.: US 12,326,068 B2
(45) Date of Patent: Jun. 10, 2025

(54) PERFORATING GUN SYSTEM

(71) Applicant: HARRISON JET GUNS II, L.P., Kennedale, TX (US)

(72) Inventor: James F. Shelton, Kennedale, TX (US)

(73) Assignee: Harrison Jet Guns II, L.P., Kennedale, TX (US)

( * ) Notice: Subject to any disclaimer, the term of this patent is extended or adjusted under 35 U.S.C. 154(b) by 11 days.

(21) Appl. No.: 18/270,280

(22) PCT Filed: Dec. 28, 2021

(86) PCT No.: PCT/US2021/065359
§ 371 (c)(1),
(2) Date: Jun. 29, 2023

(87) PCT Pub. No.: WO2022/147023
PCT Pub. Date: Jul. 7, 2022

(65) Prior Publication Data

US 2024/0117717 A1 Apr. 11, 2024

Related U.S. Application Data

(60) Provisional application No. 63/132,594, filed on Dec. 31, 2020.

(51) Int. Cl.
*E21B 43/116* (2006.01)
*E21B 43/119* (2006.01)
*E21B 43/1185* (2006.01)

(52) U.S. Cl.
CPC ..... *E21B 43/116* (2013.01); *E21B 43/119* (2013.01); *E21B 43/1185* (2013.01)

(58) Field of Classification Search
CPC ... E21B 43/119; E21B 43/1185; E21B 43/116
See application file for complete search history.

(56) References Cited

U.S. PATENT DOCUMENTS

| | | | | |
|---|---|---|---|---|
| 10,914,145 | B2 * | 2/2021 | Sullivan | E21B 43/1185 |
| 11,215,041 | B2 * | 1/2022 | Knight | E21B 43/116 |
| 2003/0047358 | A1 | 3/2003 | Bonkowski | |
| 2019/0085664 | A1 | 3/2019 | Hardesty et al. | |
| 2019/0330961 | A1 | 10/2019 | Knight et al. | |
| 2020/0048996 | A1 | 2/2020 | Anthony et al. | |
| 2020/0284126 | A1 | 9/2020 | Mauldin et al. | |
| 2020/0362676 | A1 * | 11/2020 | Goyeneche | F42B 3/02 |

OTHER PUBLICATIONS

International Search Report and Written Opinion of the International Searching Authority for PCT/US2021/065359, mailed May 3, 2022 (16 pages).

* cited by examiner

*Primary Examiner* — Yong-Suk (Philip) Ro
(74) *Attorney, Agent, or Firm* — WARNER NORCROSS + JUDD LLP

(57) ABSTRACT

An improved perforating gun system. The perforating gun system includes a perforating gun having a shaped charge positioning tube that is securely received within a female opening in a tandem to provide a 360-degree connection to ground. The shaped charge positioning tube includes segmented end portions that extend over first and second contact housings. Each contact housing includes a contact pin that is biased outwardly by a spring, the spring comprising a portion of an electrical path for a firing signal.

8 Claims, 6 Drawing Sheets

PERFORATING GUN SYSTEM

CROSS-REFERENCE TO RELATED APPLICATIONS

This application claims the benefit of U.S. Provisional Application 63/132,594, filed Dec. 31, 2020, the disclosure of which is incorporated by reference in its entirety.

TECHNICAL FIELD

The present invention relates to perforating gun systems having penetrating shaped charges to generate entrance holes through a wellbore casing.

BACKGROUND

In oil and gas operations, it is a known practice to install a well casing into a borehole that has been drilled into a geologic formation. A gun string is then lowered into the wellbore on a wireline opposite a hydrocarbon formation. The gun string includes shaped charges that, when fired, are formed into high-velocity jets that penetrate through the wellbore casing. The resulting perforations allow a fluid (oil or gas) to flow into the wellbore.

A gun string will typically include multiple perforating guns, each with opposing box ends having female threads. Tandems having male threads are threaded to one or both ends of each perforating gun in the gun string. In this fashion, multiple perforating guns can be connected end-to-end and simultaneously detonated within the wellbore. Despite their acceptance, however, there remains a continued need for improved perforating gun systems. In particular, there remains a continued need for improved perforating gun systems having a secure ground connection between each tandem and perforating gun in the gun string.

SUMMARY OF THE INVENTION

An improved perforating gun system is provided. The perforating gun system includes a perforating gun having a shaped charge positioning tube that is securely received within a female opening in a tandem to provide a 360-degree connection to ground. The shaped charge positioning tube includes segmented end portions that extend over first and second contact housings. Each contact housing includes a contact pin that is biased outwardly by a spring, the spring comprising a portion of an electrical path for a firing signal.

In one embodiment, the perforating gun includes a first contact housing and a second contact housing that are received within respective first and second ends of the shaped charge positioning tube. Each contact housing includes a spring-biased contact element therein. The spring-biased contact element including a first plate-and-pin biased away from a second plate-and-pin, each being electrically conductive. At least one of the contact housings includes an addressable switch therein. Each contact housing also includes a ring that is supported by a plurality of spokes. The segmented end portions of the shaped charge positioning tube extend beneath the ring and surround the contact housings, providing 360-degrees of contact with each tandem.

In another embodiment, each tandem includes an anodized pass-through element. Each pass-through element is secured within a cylindrical opening in the respective tandem by a retainer nut. As an alternative construction, each tandem includes a signal transfer pin surrounded by an insulating sleeve. The signal transfer pin is optionally die-cast or machined. The insulating sleeve includes a first half and a second half that collectively surround the signal transfer pin. The insulating sleeve includes socket openings to receive a contact pin protruding from the perforating gun. A signal transfer spring urges the contact pin into engagement with the signal transfer pin, thereby creating a positive connection.

The gun string can be assembled on-site by threadably engaging perforating guns and tandems in an alternating sequence. The tandems includes a socket opening for receiving a spring-biased contact pin, which is in electrical communication with an addressable switch within a perforating gun. The gun string is then lowered into a wellbore having a wellbore casing, and a firing signal causes the shaped charges to detonate, creating a plurality of perforations through the wellbore casing. These and other features and advantages of the present invention will become apparent from the following description of the invention, when viewed in accordance with the accompanying drawings and appended claims.

DETAILED DESCRIPTION

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Figure 1:
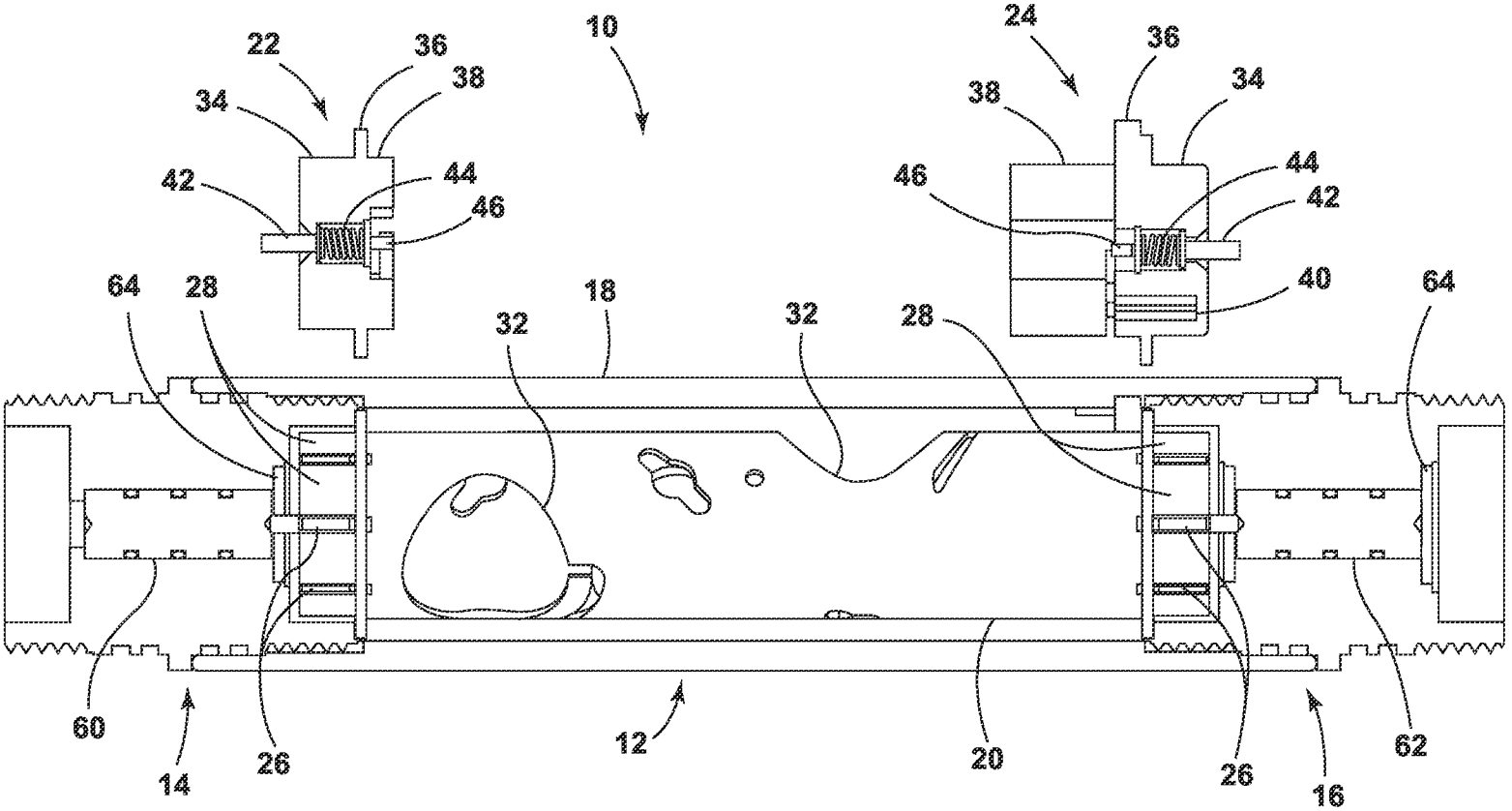
FIG. 1 is a cross-sectional view of a perforating gun system in accordance with a first embodiment.
Figure 2:
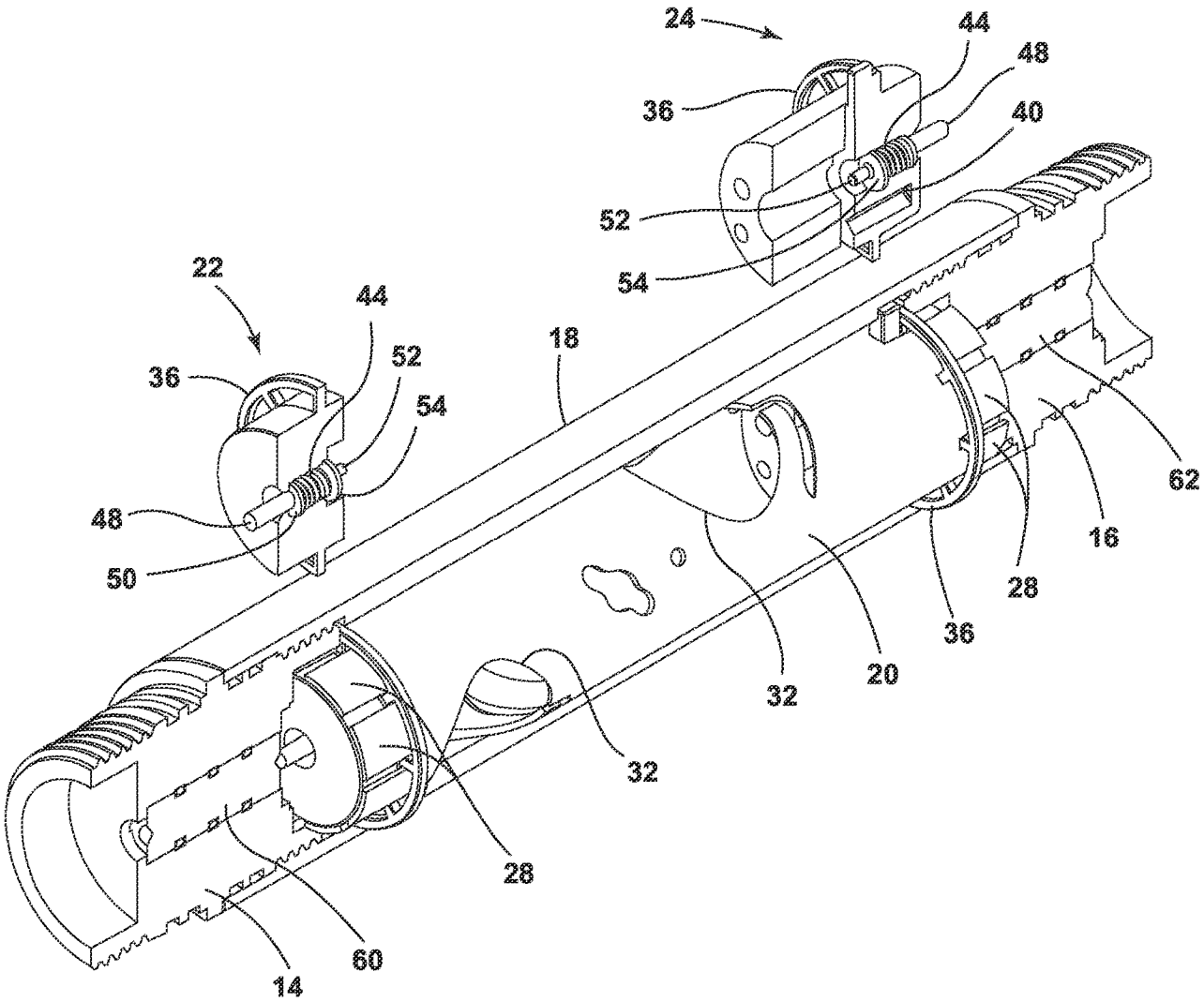
FIG. 2 is a first perspective view of the perforating gun system of FIG. 1.
Figure 3:
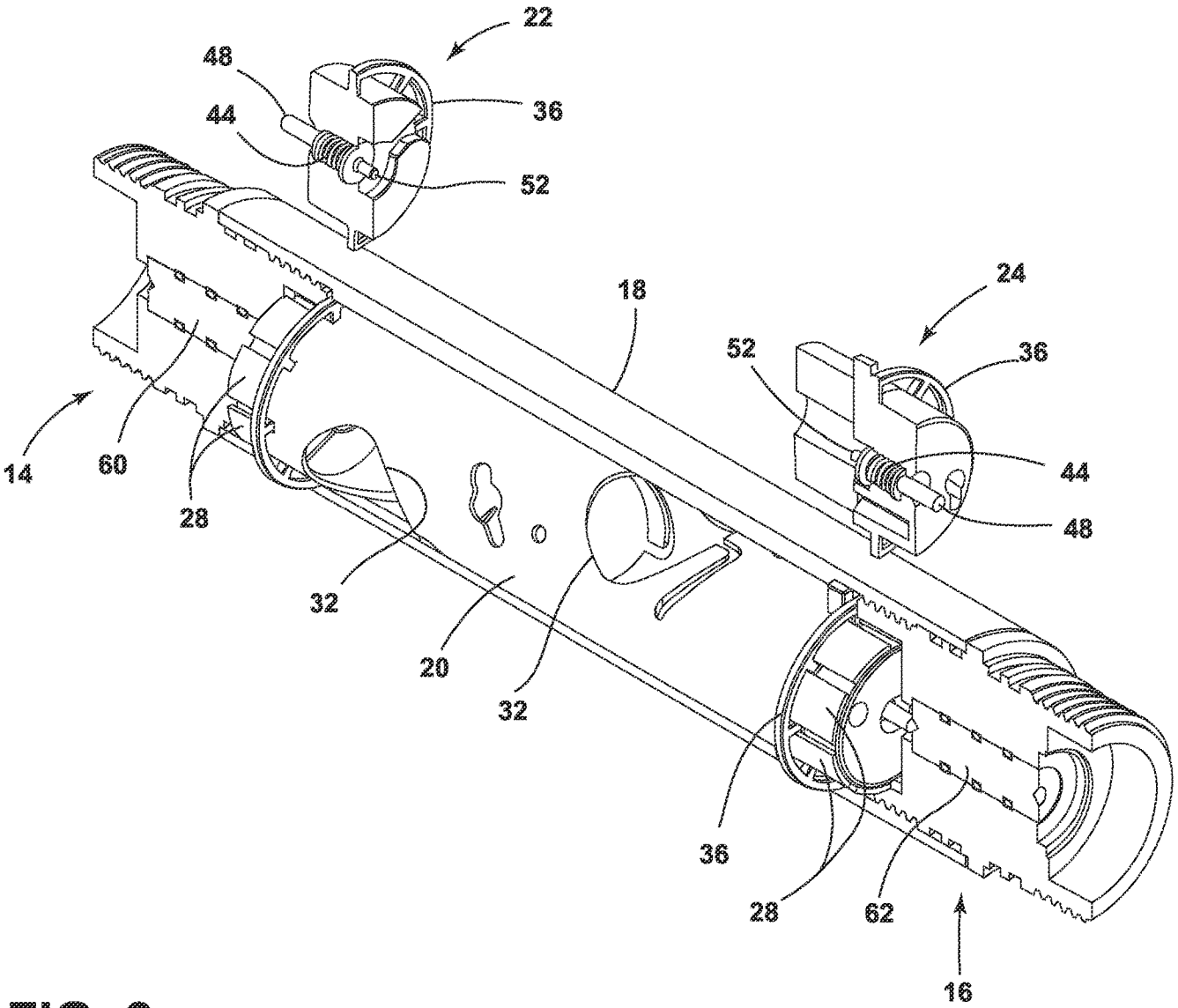
FIG. 3 is a second perspective view of the perforating gun system of FIG. 2.

Referring now to FIGS. 1-3, a perforating gun system in accordance with a first embodiment is illustrated and generally designated 10. The perforating gun system 10 includes a perforating gun 12 and first and second tandems 14, 16. The perforating gun 12 includes an outer gun barrel 18, an internal shaped charge positioning tube 20, a first contact housing 22, and a second contact housing 24, each being discussed below.

The outer gun barrel 18 includes opposing box ends, and the tandems 14, 16 are threaded to the respective box ends of the outer gun barrel 18 so that two or more perforating guns can be joined in series in a gun string. The outer gun barrel 18 is cylindrical and includes a length that is greater than the length of the shaped charge positioning tube 20, such that the outer gun barrel 18 extends beyond the shaped charge positioning tube 20.

Figure 4:
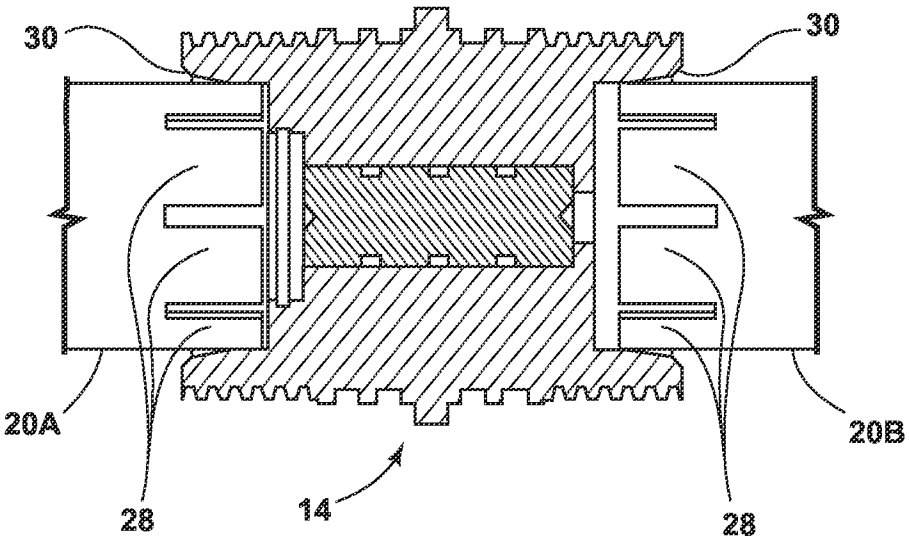
FIG. 4 is a cross-sectional view of a tandem and two shaped charge positioning tubes in accordance with the embodiment of FIG. 1.

The shaped charge positioning tube 20 is generally formed from an electrically conductive material, for example stainless steel. Each end portion of the shaped charge positioning tube 20 defines a plurality of longitudinal slots 26, such that the shaped charge positioning tube 20 includes castellated or segmented end portions having a plurality of flanges 28. As shown in FIG. 4, two shaped charge positioning tubes 20A, 20B are press-fit into attachment with each tandem 14, the tandem 14 including a sloped sidewall 30 defining a funneled opening. The tandem 14 locks down on the shaped charge positioning tube 20, and in particular the plurality of flanges 28, creating a 360-degree secure ground connection.

The shaped charge positioning tube 20 also includes a cylindrical body having multiple shaped charge openings 32 that receive a corresponding number of shaped charges. The openings 32 are angularly offset from each other in the current embodiment, but can be in axial alignment in other embodiments. The shaped charge positioning tube 20 includes two shaped charge openings 32 in the illustrated embodiment, while other embodiments the internal tube 20 can include greater or fewer number of shaped charge openings.

As noted above, the perforating gun 12 includes a first contact housing 22 and a second contact housing 24. Each contact housing 22, 24 is formed from an electrically insulating material, for example molded plastic. In addition, each contact housing 22, 24 is partially received within the shaped charge positioning tube 20. Each contact housing 22, 24 includes an outer portion 34, a ring 36 (supported by spokes), and an inner portion 38. The outer portion 34 of the second contact housing 24 also includes an addressable switch housing 40. The inner portion 38 of each contact housing 22, 24 includes an outer diameter that is approximately equal to the inner diameter of the outer gun barrel 18. Each contact housing 22, 24 also includes a top contact element 42, a signal transfer spring 44, and a bottom contact element 46. As shown in FIGS. 2-3, the top contact element 42 includes a signal transfer pin 48 joined to a top contact plate 50, and the bottom contact element 46 includes a signal transfer pin 52 joined to a bottom contact plate 54. The bottom contact plate 54 includes a greater diameter than that of the top contact plate 50, and the spring 44 urges the plates 50, 54 away from each other, such that a positive connection is maintained with the respective tandem.

As also shown in FIGS. 1-3, the first tandem 14 includes a first solid anodized pass-through element 60 and the second tandem 16 includes a second solid anodized pass-through element 62. Each pass-through element 60, 62 is secured within a cylindrical opening in the respective tandem 14, 16 by a retainer nut 64. The retainer nut 64 is received within a threaded female opening and includes a central opening for a contact pin 42. In operation, the firing signal is passed through the first tandem 14 to the perforating gun 12 and subsequently to the second tandem 16 to an adjacent perforating gun. In particular, the firing signal passes through the pass-through element 60 to the top contact element 42 of the first contact housing 22. A signal fire wire (not shown) extends between the bottom contact element 46 to allow the firing signal to directly pass to adjacent perforating guns.

Figure 5:
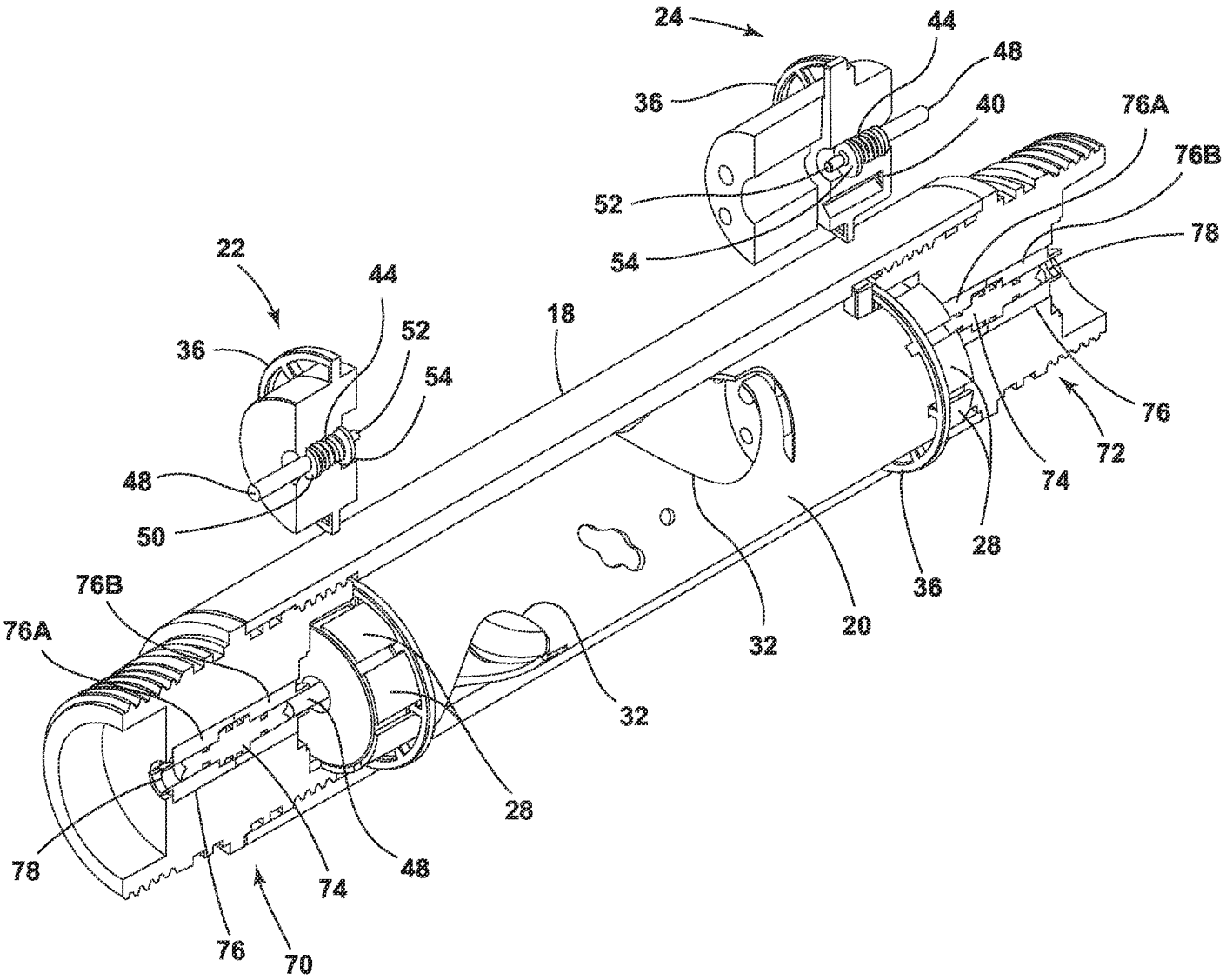
FIG. 5 is a first perspective view of a perforating gun system in accordance with a second embodiment.
Figure 6:
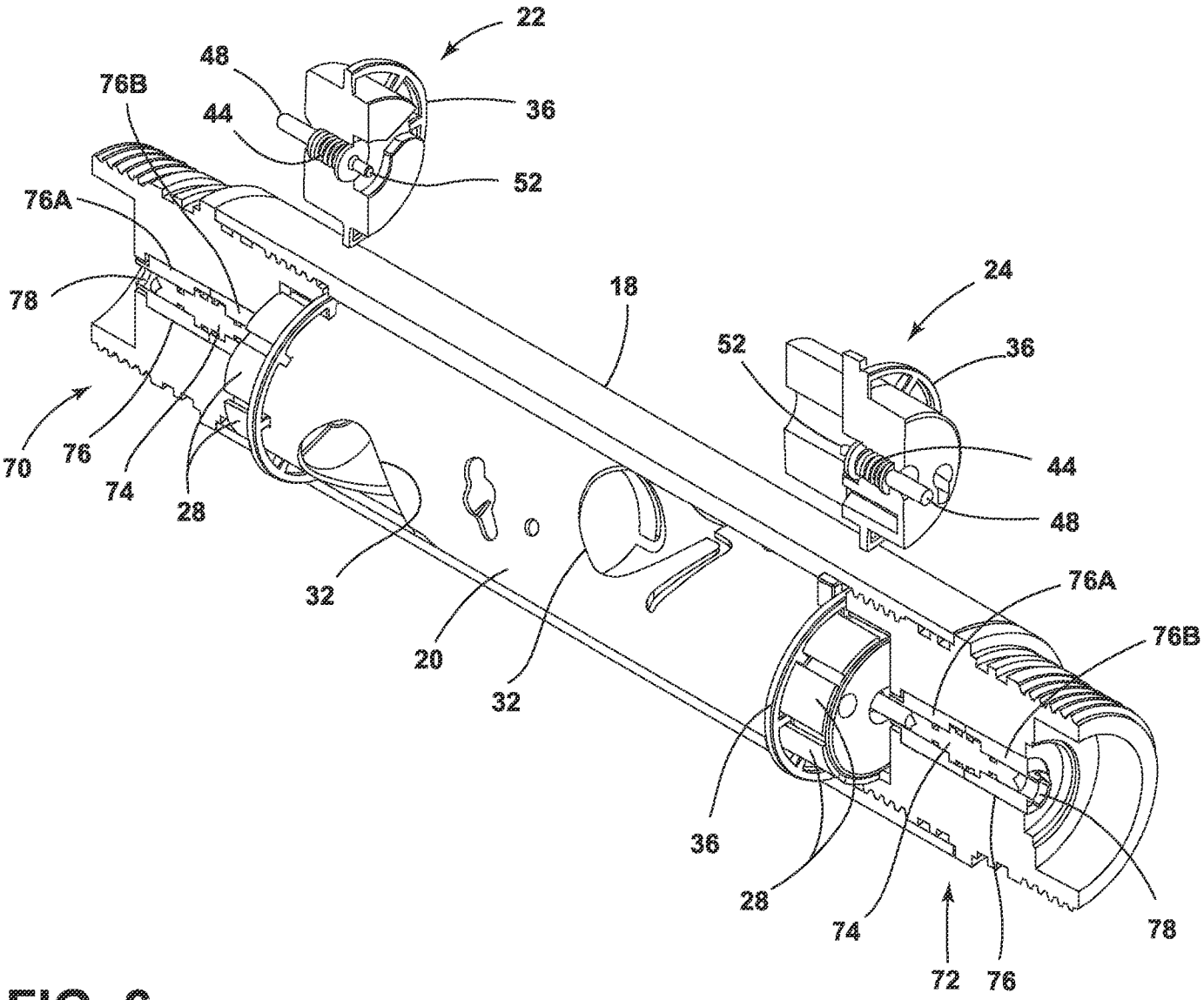
FIG. 6 is a second perspective view of the perforating gun system of FIG. 5.

Referring now to FIGS. 5-6, first and second tandems 70, 72 according to a second embodiment are illustrated. The first and second tandems 70, 72 differ from the embodiment of FIGS. 1-4 in that the tandems 14, 16 of FIGS. 5-6 now include a signal transfer pin 74 within an insulating sleeve 76. The signal transfer pin 74 is electrically conductive, optionally being die-cast or machined. The insulating sleeve 76 includes a first half 76A and a second half 76B that collectively surround the signal transfer pin 74. The insulating sleeve 76 includes socket openings 78 on opposing ends thereof. Each socket opening 78 receives a contact pin 48 protruding from a contact housing 22 or 24. The signal transfer spring 44 urges the contact pin 48 into contact with the signal transfer pin 74, thereby creating a positive connection. The signal transfer element 74 does not protrude from the pass-through housing 76, however, and is instead slightly recessed therein.

In operation, the firing signal is passed through the first tandem 70 to the perforating gun 12 and subsequently to the second tandem 72 (to adjacent perforating gun). In particular, the firing signal passes through the signal transfer pin 74 to a first contact pin 48 of the perforating gun 12. The firing signal is passed to an addressable switch (within addressable switch housing 40) and is passed by a second contact pin 48 to a second signal transfer element 74 in the second tandem 72. A signal fire wire (not shown) extends between inner contact pins 52 to allow the firing signal to directly pass to adjacent perforating guns.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

What is claimed is:

1. A perforating gun system comprising:

first and second tandems; and a perforating gun joined to the first and second tandems and including:

an outer gun barrel, a shaped charge positioning tube within the outer gun barrel, a first contact housing including a first contact element biased axially outward by a first spring, the first contact housing including a first ring supported by a first plurality of spokes, and a second contact housing including a second contact element biased axially outward by a second spring, the second contact housing including a second ring supported by a second plurality of spokes, wherein the shaped charge positioning tube includes first and second segmented end portions that are received within the respective first and second tandems to create a secure connection to ground, wherein the first segmented end portion includes a first plurality of castellated flanges that extend between adjacent ones of the first plurality of spokes, radially inward of the first ring, for engaging a sloped opening in the first tandem, and wherein the second segmented end portion includes a second plurality of castellated flanges that extend between adjacent ones of the second plurality of spokes, radially inward of the second ring, for engaging a sloped opening in the second tandem.

2. The perforating gun system of claim 1 wherein:

the first contact element includes a first contact plate joined to a first contact pin that protrudes from the first contact housing; and wherein the second contact element includes a second contact plate joined to a second contact pin that protrudes from the second contact housing.

3. The perforating gun system of claim 1 wherein the first and second tandems include an electrically conductive signal transfer pin within a non-conducting pass-through housing.

4. The perforating gun system of claim 1 wherein the first and second contact housings are formed from a non-conductive material and wherein the shaped charge positioning tube is formed from metal.

5. The perforating gun system of claim 1 wherein the first and second springs are electrically conductive and comprise at least a portion of an electrical path for a firing signal.

6. The perforating gun system of claim 1 wherein each segmented end portion includes n-number of rectangular flanges that are separated by n-number of axial grooves.

7. A perforating gun system comprising:

first and second tandems; and a perforating gun joined to the first and second tandems and including:

an outer gun barrel, a shaped charge positioning tube within the outer gun barrel, a first contact housing including a first contact element biased axially outward by a first spring, and a second contact housing including a second contact element biased axially outward by a second spring, wherein the shaped charge positioning tube includes first and second segmented end portions that are received within the respective first and second tandems to create a secure connection to ground, wherein the first and second tandems include an anodized pass-through elements contained within a central through-bore.

8. A perforating gun system comprising:

first and second tandems; and a perforating gun joined to the first and second tandems and including:

an outer gun barrel, a shaped charge positioning tube within the outer gun barrel, a first contact housing including a first contact element biased axially outward by a first spring, and a second contact housing including a second contact element biased axially outward by a second spring, wherein the shaped charge positioning tube includes first and second segmented end portions that are received within the respective first and second tandems to create a secure connection to ground, wherein each segmented end portion includes n-number of rectangular flanges that are separated by n-number of axial grooves, wherein each of the first and second tandems includes a sloped opening for receiving the shaped charge positioning tube therein.

* * * * *